United States Patent [19]

Landon

[11] 4,099,441

[45] Jul. 11, 1978

[54] HOLDER FOR GUITARS AND THE LIKE

[76] Inventor: James M. Landon, 13847 Chandler Blvd., Van Nuys, Calif. 91401

[21] Appl. No.: 700,345

[22] Filed: Jun. 28, 1976

[51] Int. Cl.[2] ..... G10D 3/00

[52] U.S. Cl. ..... 84/327; 248/176

[58] Field of Search ..... 224/45 R, 50, 46 R; 84/327; 211/13; 248/121, 176, 177; 294/110 A, 110 R

[56] References Cited

U.S. PATENT DOCUMENTS

| | | | |
|---|---|---|---|
| 1,171,440 | 2/1916 | Immell | 294/110 A |
| 1,550,138 | 8/1925 | Baker | 248/176 |
| 1,708,285 | 4/1929 | Truett et al. | 84/327 |
| 2,593,077 | 4/1952 | Vogt | 248/176 |

FOREIGN PATENT DOCUMENTS

| | | | |
|---|---|---|---|
| 344,154 | 10/1904 | France | 84/327 |

*Primary Examiner*—Trygve M. Blix
*Assistant Examiner*—Kenneth Noland
*Attorney, Agent, or Firm*—Gilbert Kivenson

[57] ABSTRACT

A holding stand for guitars and the like in which clamping arms acting in unison apply firm pressure to a musical instrument. Arms may be pedal actuated and spring loaded or may operate from the weight of the instrument itself. The clamping arms are mounted on a rockable base which produces deflection if contact is made with the instrument being held. The base, arms and instrument return to an upright position when the contacting force is removed.

1 Claim, 4 Drawing Figures

HOLDER FOR GUITARS AND THE LIKE

BACKGROUND OF THE INVENTION

This invention relates to means for temporarily storing musical instruments during intermission periods and at other times when the musician finds it inconvenient to place an instrument into its carrying case. Random placement of stringed instruments such as guitars and banjos on flat surfaces or leaning them against walls at intermissions in undesirable because of the danger of accidental damage.

Presently used holders include tripod devices from which the instrument is suspended. Crowded bandstand conditions will often result in the tipping of a tripod device and the breakage of the instrument. Other types of holders make use of permanently fixed stands. Although these holders cannot be tipped, they are not sufficiently resilient to prevent breakage should there be contact for example with another instrument being moved around the bandstand.

BRIEF DESCRIPTION OF THE INVENTION

It is a primary object of this invention to provide secure storage of acoustic guitars, electric guitars, banjos and similar instruments. Another object of the invention is to provide a displacable holder which will reduce the shock occurring as the result of accidental contact. It is a third object of the invention to provide means for the rapid and convenient release of the instrument whenever the user desires to recover it.

The invention is comprised of a frame which is shaped to hold a stringed instrument, a releasable retaining device and a rockable base. In one embodiment a foot pedal is depressed to open the retaining device, the musical instrument placed within the holder and the pedal released. The holder and pedal mechanism are rigidly mounted on the base so weighted that it recovers its original orientation after being displaced. Should accidental contact be made with the instrument it will tend to move away from the disturbing object and then rock back to its original position. In another embodiment of the invention the frame is so designed that lowering the musical instrument into the holder will by gravity cause a firm engagement of the retaining means with the instrument.

BRIEF DESCRIPTION OF THE DRAWINGS

These and other objectives and advantages which will become subsequently apparent can be found in the details of construction and operation which are herein more fully described and claimed, reference being had to the following drawings:

DETAILED DESCRIPTION OF THE DRAWINGS

Figure 1:
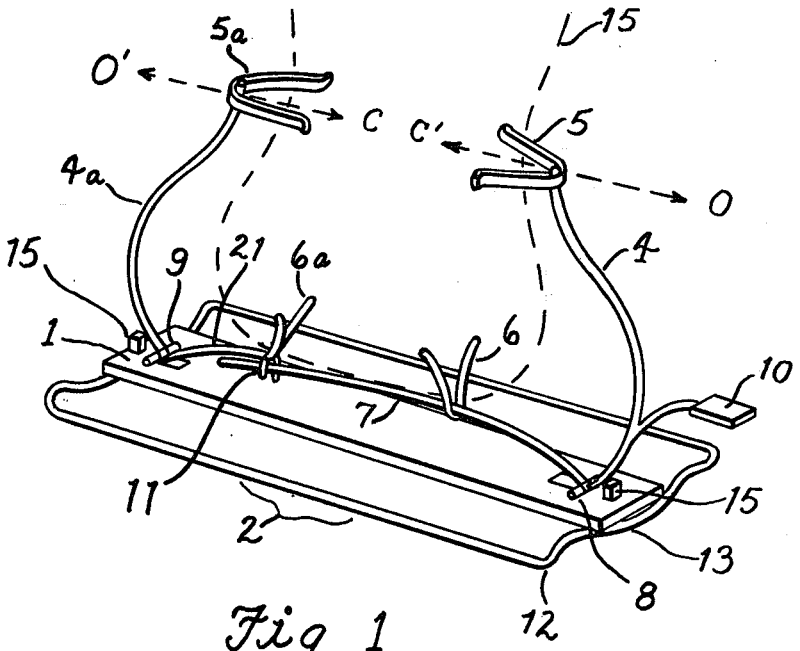
FIG. 1 is a perspective of a preferred embodiment of the invention showing the frame, retaining means and the rockable base.
Figure 2:
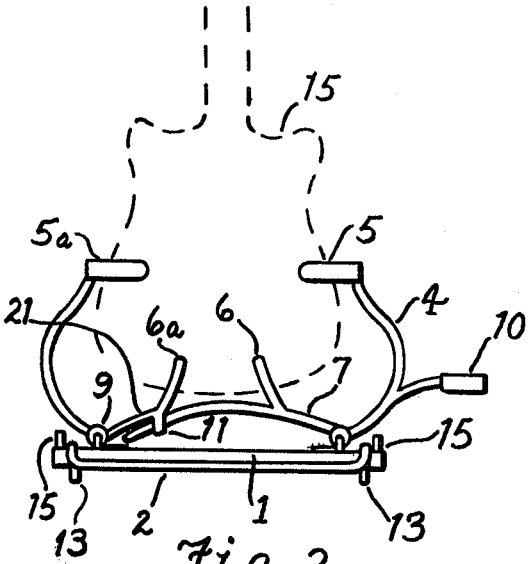
FIG. 2 is a side elevation of the invention.

In FIGS. 1 and 2 a relatively heavy base plate 1 is firmly joined to the rocking frame 2. An arcuate vertically extending arm 4 terminates at its upper end in the instrument retainer 5. At its lower end arm 4 is bent and extended to form the arcuate and horizontally extending segment 7. The point of bending is incorporated in the pivot structure 8. It will be apparent that motion of the arm 4 in the direction 0 shown in FIG. 1 will cause an upward motion of segment 7.

A pedal assembly 10 is joined to arm 4. A second instrument retainer 6 is fixed to the end of segment 7. An arcuate vertically extending arm **4*a* similar in shape to arm 4 terminates at its upper end in the instrument retainer 5*a*. At its lower end arm 4*a* is bent to form the arcuate, horizontal segment 21. The point of bending is incorporated in the spring loaded pivot structure 9. Segment 21 terminates in the instrument retainer 6*a* and the extension 11. Spring loaded pivot structure 9 is biased so that segment 21 tends to press down on segment 7 and thus tends to maintain retainers 5 and 5*a* at a minimum horizontal separation. Pressure on pedal assembly 10 will now cause upward motion of segment 7 and outward motion of arm 4 in the direction 0. By virtue of the contact between segment 7 and segment 21 and of the pivoted relation between arm 4*a* and segment 21, arm 4*a* will now move outwardly in the direction 0′ shown in FIG. 1. The outward movements of arms 4 and 4*a* have the effect of opening the frame to receive a musical instrument. Extension 11 serves to prevent sideward motion of segment 7 with respect to segment 21. A musical instrument such as a guitar can now be placed with its bottom edges in contact with the retainers 6 and 6*a* and the pedal assembly 10 released. The spring loaded pivot 9, acting directly on arm 4*a* and on arm 4 through segments 21 and segment 7, will then cause closure of the frame and firm retention of the instrument. Depressing the pedal assembly 10 again will cause the arms 4 and 4*a*** to open and the instrument can be removed from the holder.

Side retainers 5 and **5*a* and bottom retainers 6 and 6*a*** are preferably covered with a resilient material to protect the surface finish of the musical instrument.

Adjustable stops 15 can be set to limit the outward travel of arms 4 and **4*a*** and thus accommodate a particular instrument with minimum motion.

Figure 3:
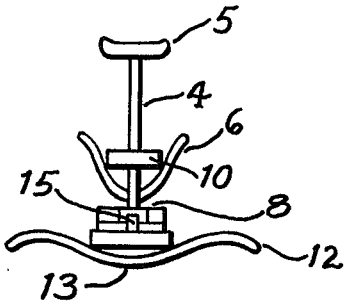
FIG. 3 is an end view of the invention.

The rocking frame 2 is shaped preferably of rod and bent to form the arcuate portions 13 at each end as is shown in FIGS. 1,2 and 3. The sides 12 of the rocking form 2 are bent downwardly to form motion limiting stops. It will be apparent that bumping of an instrument being retained in the holder at any angle other than directly in line with the opening and closing direction will result in displacement away from the disturbance rather than absorption of the blow.

Figure 4:
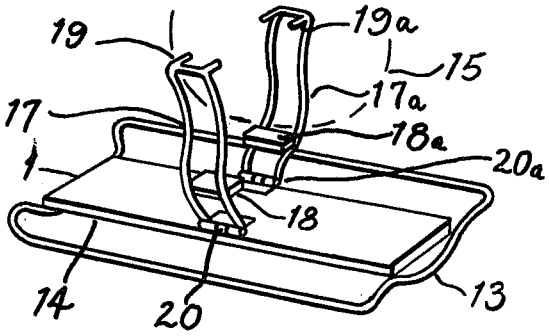
FIG. 4 is a perspective of a second embodiment of the invention.

In the embodiment shown in FIG. 4 vertical structures 17 and **17*a* are mounted transversely on base 1 by means of hinges 20 and 20*a* and terminate at their upper ends in the retaining fingers 19 and 19*a* respectively. Structures 17 and 17*a* are provided with platforms 18 and 18*a*. Hinges 20 and 20*a* incorporate internal stops to limit the outward travel of structures 17 and 17*a*. When a musical instrument such as a guitar is placed between the structures 17 and 17*a*, it will first contact the platforms 18 and 18*a*. The dimensions of the platforms and their separation are such that the weight of the instrument will produce torque about hinges 20 and 20*a* which tends to move the retaining fingers 19 and 19*a* inwardly into contact with the surfaces of the instrument. Lifting of the instrument removes the torque and allows the structures 17 and 17*a* to return to their original open position. Retaining fingers 19 and 19*a* and platforms 18 and 18***a* are preferably covered with resilient material to protect the surfaces of the instrument.

The invention as described above provides convenient storage for musical instruments such as guitars and banjos. Stored instruments are protected from the damaging effects of impact by provisions for swinging away and then returning to their original position.

While two particular embodiments of the invention have been described, it will be apparent to those skilled in the art that alterations and modifications may be made without departing from the basic concept of the invention. It would be possible for example to modify the first embodiment to provide transverse holding rather than end holding of the musical instrument. Upper or lower retainers or both could be specially shaped to fit a particular instrument or various kinds of interchangeable inserts for retaining provided. Other motion transmitting arrangements could be used to cause both arms to open and close in unison. Other forms of a rocking base could be provided to give equal rocking motion in all directions. These and other modifications can be made without departing from the spirit of the invention or the scope of the subjoined claims.

What is claimed is:

1. In a weighted and rockable stand for holding guitars and similar musical instruments, an arrangement for retaining a musical instrument comprising in combination:

a. two spring loaded, individually pivoted clamping arms, each of said arms having instrument retainer means at its free end for holding said musical instrument in an upright position and, each one of said arms having an inward extension from its respective pivot, one extension bening slidably coupled to the other by a guide means, each of said extensions also having instrument retaining means;

b. a foot pedal affixed to one of the clamping arms;

c. spring biased hinges serving as pivots for said arms and their extensions;

whereby pressure on said pedal opens both arms simultaneously and release of pressure produces simultaneous closure.

* * * * *